United States Patent [19]

Salomon

[11] 4,061,356

[45] Dec. 6, 1977

[54] SAFETY ARRANGEMENT FOR A SKI

[76] Inventor: Georges Pierre Joseph Salomon, Chemin de la Prairie prolonge, 74003 Annecy, France

[21] Appl. No.: 673,103

[22] Filed: Apr. 2, 1976

[30] Foreign Application Priority Data

Apr. 8, 1975 France ..... 75.10921

[51] Int. Cl.[2] ..... A63C 7/10

[52] U.S. Cl. ..... 280/605; 280/618

[58] Field of Search ..... 280/605, 604, 12 AB, 280/618, 617; 188/8, 5, 6, 7

[56] References Cited

U.S. PATENT DOCUMENTS

| | | | |
|---|---|---|---|
| 3,083,028 | 3/1963 | Miller | 280/605 |
| 3,410,568 | 11/1968 | Wiley | 280/618 |
| 3,909,024 | 9/1975 | Salomon | 280/605 |

*Primary Examiner*—Joseph F. Peters, Jr.
*Assistant Examiner*—Milton L. Smith
*Attorney, Agent, or Firm*—Haseltine, Lake & Waters

[57] ABSTRACT

A safety arrangement for a ski comprising a binding having a plate and a brake in the form of a spade pivoted on the ski and normally biased by a resilient member into an active position in which the spade projects below the sole of the ski. The spade may be retracted into an inactive position against the action of the resilient member. The spade is movable into the inactive position when the plate is fitted on the ski and a skier's boot is retained in position on the plate.

11 Claims, 4 Drawing Figures

SAFETY ARRANGEMENT FOR A SKI

FIELD OF THE INVENTION

The present invention relates to a safety arrangement for a ski comprising a binding having a plate and a brake.

BACKGROUND

Bindings having a plate, mounted on the ski, generally comprise a fixed or releasable front abutment and a rear heel member between which is immobilized a plate, on which the ski boot is retained by retaining means. If the skier falls, there is a safety release between the ski and the plate connected to the boot.

Ski brakes associated with bindings having a plate are already known. Generally, these brakes comprise a spade pivoted on the ski and intended to dig into the snow, this spade being integral with a pedal which is located between the plate and the ski when the ski is fitted. Due to this, when this plate is fitted on the ski, it retains the spade of the ski brake in the inactive, substantially horizontal position. At the time of activation of the safety release, since the plate separates from the ski, the pedal is released and the spade may pass into the active position, under the action of a return spring, in which it projects below the sole of the ski.

A known arrangement of this type has a considerable drawback. In fact, when the boot is placed on the plate, with the ski on the ground, the skier has no means of retaining his ski, especially if the plate is provided at the rear with a "step-in" device making it possible to ensure automatic engagement of the boot on the plate. The ski may thus move when the skier introduces his boot into the binding, which makes fitting of the ski difficult, but above all the ski may escape the skier's control, slide down the slope, injure third parties, break or become lost and this despite the fact that it is provided with a ski brake, since the latter is locked in the inactive position by the plate. If the skier is forced to bend down to hold his ski with his hand at the time of fitting, he loses the advantage of having a "step-in" device and a ski brake, which are precisely intended to prevent this movement.

SUMMARY OF THE INVENTION

The essential object of the present invention is to remedy this drawback.

To this end, a safety arrangement for a ski comprising a binding with a plate and a brake, the latter comprising a spade pivoted on the ski and normally biased by a resilient member into an active position, in which the spade projects below the sole of the ski, this spade being retractable into an inactive position against the action of the resilient member, is characterised in that it comprises means on the plate for cooperating with the boot to enable the boot to move the space into an inactive position solely if both the plate is in the fitted position on the ski and the boot is retained in position on the plate.

The device according to the invention offers the advantage that the ski brake automatically passes into the active braking position as soon as a safety release takes place between the plate and the ski, as in the case of known solutions, and also when there is a voluntary separation of the plate and boot. In this case, although the plate is still immobilized on the ski, the spade of the ski brake is in the active position and prevents the ski from being lost down the slope and the skier may attach his ski easily without any danger of losing it.

BRIEF DESCRIPTION OF THE DRAWING

One embodiment of the present invention will be described hereafter, as a non-limiting example, with reference to the accompanying drawings in which.

DETAILED DESCRIPTION

Figure 1:
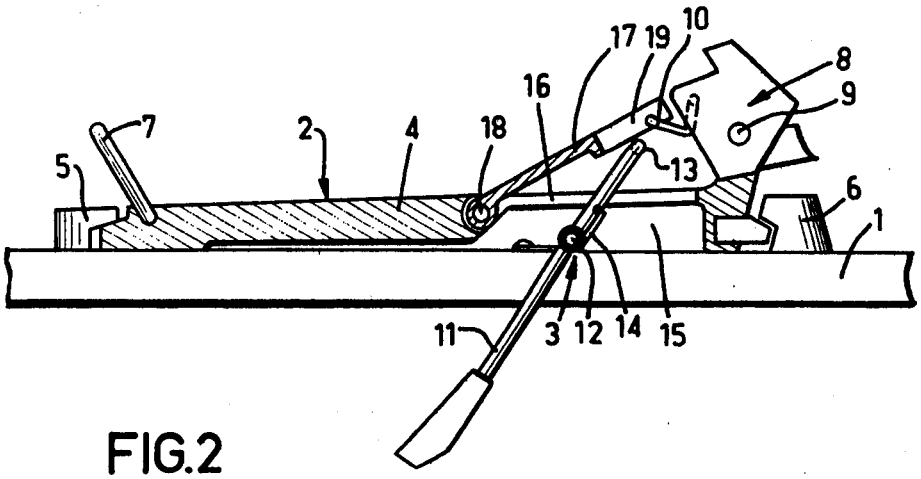
FIG. 1 is a longitudinal vertical section of a safety arrangement for a ski comprising a binding with a plate and a ski brake, the binding being engaged and the brake being in the active braking position.
Figure 2:
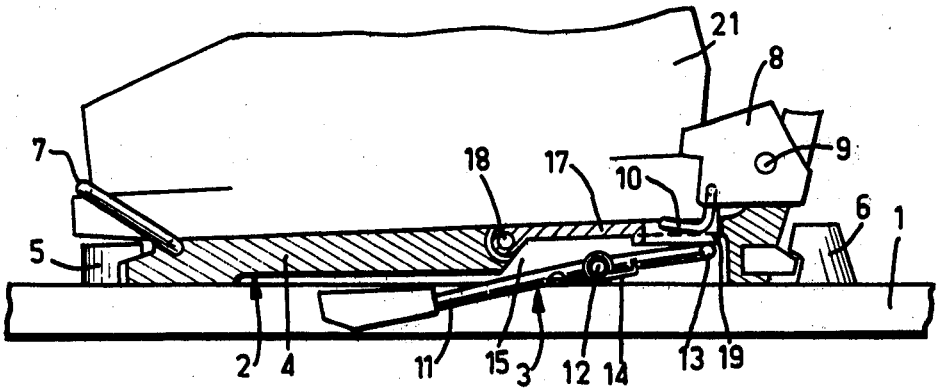
FIG. 2 is a view similar to that of FIG. 1, a boot being placed on the plate which is itself engaged and the brake being in the inactive position.

The safety arrangement illustrated in FIG. 1 is mounted on a ski 1. This arrangement comprises a binding 2 having a plate, of any known type and a ski brake 3 also of any known type. The binding 2 comprises a plate proper 4 engaged between a front fixed or releasable abutment 5 and a device 6 for retaining the rear of the plate on the ski, this device being able to release vertically and laterally. At the front, the plate 4 supports a hoop 7 pivoted about a transverse pivot and intended to retain the front of the boot and at the rear, a "step-in" retainer device 8, pivoted about a transverse pivot 9 and intended to retain the rear of the sole on the plate, as shown in FIG. 2.

In this non-limiting embodiment of the invention, the ski brake 3 is located between the front abutment 5 and the rear retaining device 6. The brake 3 essentially comprises two spades 11 arranged respectively on two sides of the ski. Each of these spades is constituted by a rod which is bent at 90° in the direction of the longitudinal axis of the ski, to form a transverse pivot shaft 12. This shaft is in turn extended by a central U-shaped part directed towards the rear and constituting a brake pedal 13. The brake 3 is normally urged into an active position, illustrated in FIG. 1, by a spring 14, for example a torsion spring, which bears on the ski and under the pedal 13 in order to tend to rotate this pedal and the spades 11 in counter-clockwise direction in FIG. 1.

The arrangement formed by the pivot shafts 12, the brake pedal 13 and the spring 14 is housed below the plate 4 in a recess 15 provided for this purpose. Above this recess, the plate 4 is provided with an opening 16 which allows the pedal 13 to project above the plate 4, in the active position (FIG. 1), under the action of the spring 14.

Figure 4:
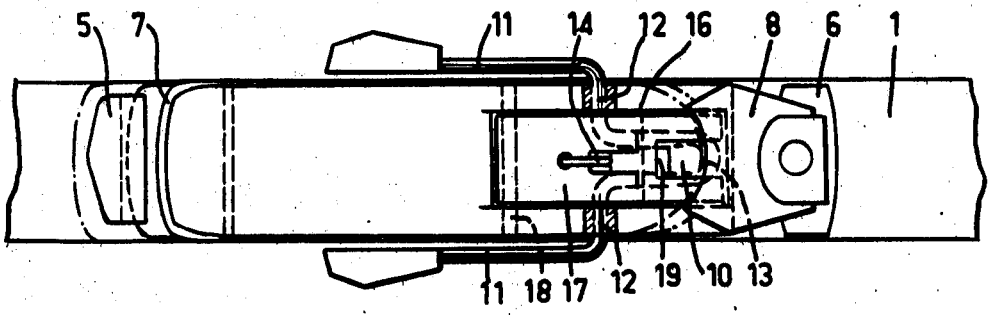
FIG. 4 is a plan view of the binding and of the brake.

Pivoted in the opening 16 is an additional pedal 17 mounted to pivot at its front end about a transverse pivot 18 on the plate 4. The contour of this pedal corresponds substantially to that of the opening 16 which it closes when the pedal is flat, as can be seen in FIG. 4. The rear part of the additional pedal 17 comprises a U-shaped notch 19, through which may pass a step-in pedal 10 of the "step-in" device 8, when the additional pedal 17 is raised. This rear part is located just above the pedal 13 of the brake and is in permanent contact with the latter.

In FIG. 1, the arrangement of the binding 2 and of the brake 3 is shown in the stand-by position for a "step-in" mounting. In this case the plate 4 is immobilized by the front abutment 5 and the rear retaining device 6, and the brake 3 is in the active position, i.e. the spade 11 projects downwards under the sole of the ski and the pedal 13 is raised above the upper surface of the plate 4, thereby keeping the additional pedal 17 raised. When the ski boot 21 is placed on the plate 4 (FIG. 2), the heel of the boot causes the additional pedal 17 to pivot in clockwise direction about the pivot 18 and the later in turn acts on the brake pedal 13 to pivot the spade 11 in this same direction and bring it into the inactive position, in which it is located in the vicinity of the edge of the ski. As has been shown previously, the pivoting movement of the pedal 17 is made possible by the provision of the notch 19 in which the pedal 10 of the "step-in" device 8 may pass. The heel of the boot also acts on this pedal to cause engagement of this device as shown in FIG. 2.

Figure 3:
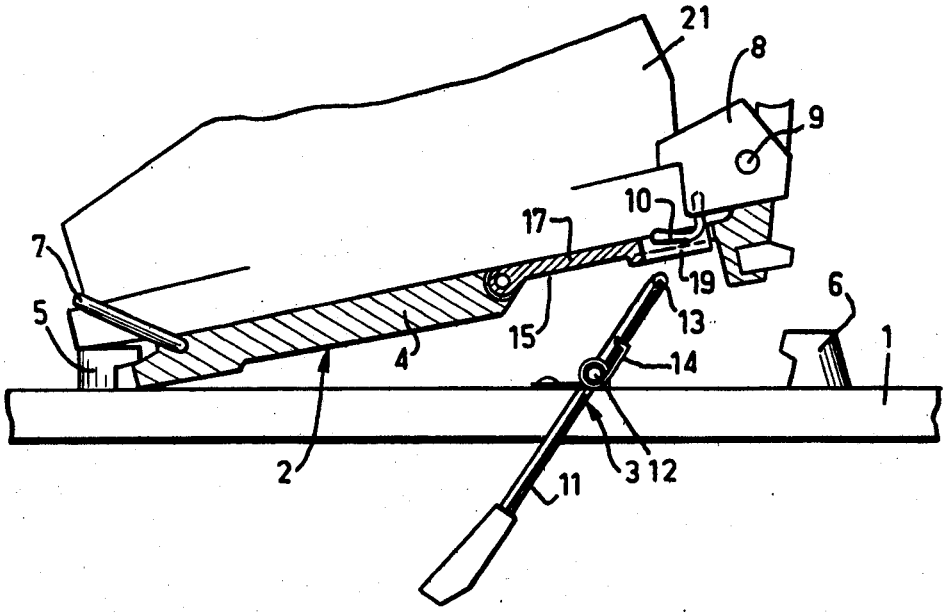
FIG. 3 is a view similar to those of FIGS. 1 and 2, the binding being shown during the course of engagement and the brake being in the active position.

If the binding releases as a safety measure, subsequent to the skier falling forwards or sideways, the plate 4 is released from the rear retaining device 6 (FIG. 3), but it still remains integral with the boot. Since the plate leaves the ski, the brake 3 is released and the spade 11 may immediately pass into the active position under the action of the return spring 14.

Although in the above-described embodiment, the brake 3 is located between the front abutment 5 and the rear retaining device 6 of the binding, it may also be placed elsewhere on the ski and comprise an actual or virtual pivot shaft, arranged differently and not transversely.

Likewise, the additional pedal 17 may be eliminated, the boot thus acting directly on the brake pedal 13 projecting through the opening 16, when the boot is put in position on the plate 4.

In the present case, the pedal 17 is provided at its lower part with a shaped member such that it pushes the pedal 13 sufficiently below the plate 4 to insure that said pedal 13 does not hinder the release as a safety measure.

To this end, it should be noted that the safety bindings 5 and 6 are not shown in detail, since they are subordinate to the invention and may be chosen from any appropriate type, to be on the ski and/or in the plate.

Nevertheless, it is clear that the invention has a maximum advantage in the case where the plate has a length at least equal to that of the sole.

According to another variation, it may be arranged that one of the members supported by the plate 4 and moved when the boot is fitted on this plate, causes the passage of the brake 3 into the inactive position. In particular, this brake may be controlled by the hoop 7 for retaining the front of the boot or even by one of the members of the "step-in" device 8, namely its jaw, its "step-in" pedal 10 or its arming lever.

It is also possible to provide two individual controls for the brake, namely one on the plate 4 and the other on the boot, an AND-circuit ensuring raising of the spade 11 if the two controls are actuated.

In the case where the brake is located outside the region covered by the plate 4, it is possible for the control to take place remotely by means of a feeler, sliding for example under the action of the sole or an upper face of the boot when being mounted on the ski.

It will be understood that the invention is not limited to the embodiments which have been described and which are given as purely non-limiting examples. Other variations could be conceived without diverging from the framework of the present invention.

What is claimed is:

1. A safety arrangement for a ski comprising a binding having a plate, a brake in the form of a spade pivoted on the ski and normally biased by a resilient member into an active position in which said spade projects below the sole of said ski, said spade being retractable into an inactive position against the action of said resilient member, retainer means on said plate for retaining a skier's boot on said plate, and means on said plate for cooperating with said boot to enable said boot to move said spade into said inactive position when said plate is fitted on said ski and the skier's boot is positioned on said plate to be retained by said retainer means.

2. A safety arrangement for a ski according to claim 1, in which said brake is located between a front abutment and a rear plate retaining device, said plate being provided with an opening, said brake comprising a brake pedal integral with the spade and projecting through said opening and above the plate in the active position of the spade in order to be depressed by the boot when the latter is positioned on the plate as fitted on the ski.

3. A safety arrangement for a ski according to claim 2, said means for cooperating with said boot comprising an additional pedal pivoted on said plate about a transverse pivot engageable with said boot, said additional pedal being connected to said retainer means and having a contour corresponding substantially to that of said opening in said plate.

4. A safety arrangement for a ski according to claim 3, in which said additional pedal has a front portion pivoted on said plate, and a rear portion provided with a notch, said retainer means comprising a "step-in" pedal movable in said notch and a "step-in" device pivotably mounted at the rear of said plate and connected to said "step-in" pedal.

5. A safety arrangement for a ski according to claim 3, in which said brake comprises two of said spaded located on either side of the ski, said spades being constituted by rods bent at 90° in the direction of the longitudinal axis of the ski to form two coxial pivot shafts for the brake, said two shafts being extended opposite the spades by a central U-shaped part constituting said brake pedal located below said opening provided in said plate such that the blade is depressed to inactive position by contact of the boot with the said additional pedal in the course of fitting the boot on the ski.

6. A safety arrangement for a ski according to claim 5, in which said brake is biased into said active position by a torsion spring comprising two end sides bearing under the two sides of said U-shaped part and an intermediate part bearing on said ski.

7. A safety arrangement for a ski according to claim 1, wherein the means on said plate for cooperating with said boot comprises a movable member supported at the rear of said plate and positioned for being contacted by the boot during fitting to effect movement of said brake into said inactive position.

8. A safety arrangement for a ski according to claim 7, wherein said means on said plate for cooperating with said boot comprises a pedal connected to said retainer means.

9. A safety arrangement for a ski according to claim 1, said retainer means comprising a hoop on said plate for retaining the front part of said skier's boot.

10. A safety arrangement for a ski according to claim 1, wherein said means on said plate for cooperating with said boot comprises a pedal pivotably connected to said plate and bearing against said spade, said pedal being raised with said spade in active position, said pedal being lowered by said ski boot to move said spade to inactive position.

11. A safety arrangement for a ski according to claim 10, wherein said means on said plate for cooperating with said boot further comprises means connecting said pedal to said retainer means for moving the latter to inactive position when the pedal is lowered.

* * * * *